US008651236B2

(12) United States Patent
Bowden

(10) Patent No.: US 8,651,236 B2
(45) Date of Patent: Feb. 18, 2014

(54) OPERATOR CAGE

(75) Inventor: Frank Roger Bowden, Totternhoe (GB)

(73) Assignee: Niftylift Limited, Milton Keynes (GB)

( * ) Notice: Subject to any disclaimer, the term of this patent is extended or adjusted under 35 U.S.C. 154(b) by 562 days.

(21) Appl. No.: 12/676,125

(22) PCT Filed: Sep. 16, 2008

(86) PCT No.: PCT/GB2008/003127

§ 371 (c)(1),
(2), (4) Date: Apr. 16, 2010

(87) PCT Pub. No.: WO2009/037429

PCT Pub. Date: Mar. 26, 2009

(65) Prior Publication Data

US 2010/0200332 A1 Aug. 12, 2010

(30) Foreign Application Priority Data

Sep. 19, 2007 (GB) ..... 0718218.1

(51) Int. Cl.
*B66F 11/04* (2006.01)

(52) U.S. Cl.
USPC ..... 182/113

(58) Field of Classification Search
USPC ..... 182/113, 2.8, 2.9
See application file for complete search history.

(56) References Cited

U.S. PATENT DOCUMENTS

| | | | | |
|---|---|---|---|---|
| 2,815,250 A | | 12/1957 | Thornton-Trump | |
| 3,638,758 A | | 2/1972 | Weisker | |
| 4,962,827 A | | 10/1990 | Garnett | |
| 4,979,588 A | * | 12/1990 | Pike et al. | 182/18 |
| 6,464,037 B2 | * | 10/2002 | Baldas et al. | 182/69.6 |
| 2007/0125600 A1 | * | 6/2007 | Bennett et al. | 182/179.1 |

FOREIGN PATENT DOCUMENTS

| | | | | |
|---|---|---|---|---|
| DE | 299 03 071 U1 | | 7/1999 | |
| EP | 1 604 944 A | | 12/2005 | |
| EP | 2 096 078 A1 | | 9/2009 | |
| GB | 1346654 A | | 2/1974 | |
| JP | 61-185799 U | | 11/1986 | |
| JP | 64-12100 U | | 1/1989 | |
| JP | 4-53800 U | | 5/1992 | |
| JP | 4-65299 U | | 6/1992 | |
| JP | 4-77600 U | | 7/1992 | |
| JP | 05124800 A | * | 5/1993 | B66F 9/24 |
| JP | 5-92298 U | | 12/1993 | |
| JP | 09-124297 A | | 5/1997 | |
| JP | 10-007398 A | | 1/1998 | |
| JP | 11-049499 A | | 2/1999 | |
| JP | 2001226097 A | * | 8/2001 | B66F 9/24 |
| JP | 2002114500 A | * | 4/2002 | B66F 9/24 |

OTHER PUBLICATIONS

International Search report issued in corresponding PCT Application No. PCT/GB2008/003127, mailed Feb. 5, 2009.
UK Search report issued in corresponding Application No. GB 0718218.1, dated Jan. 14, 2008.

* cited by examiner

*Primary Examiner* — Charles A Fox
*Assistant Examiner* — Kristine Florio
(74) *Attorney, Agent, or Firm* — Knobbe Martens Olson & Bear LLP

(57) ABSTRACT

An operator cage for a machine such as a mobile elevating work platform comprises a base unit (22) and a fence assembly (25) releasably attached to the base unit, wherein the cage (6) is constructed and arranged to be readily disassembled for convenient transportation.

8 Claims, 8 Drawing Sheets

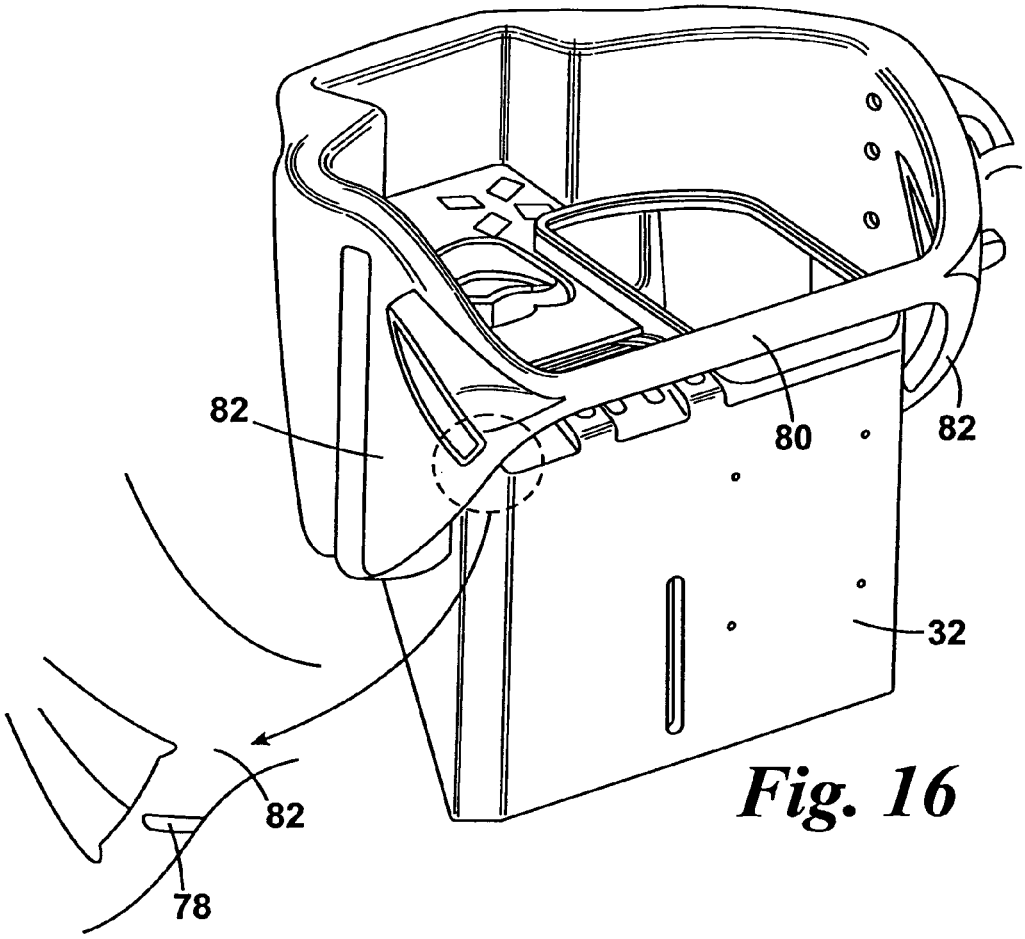
Fig. 16
Fig. 17
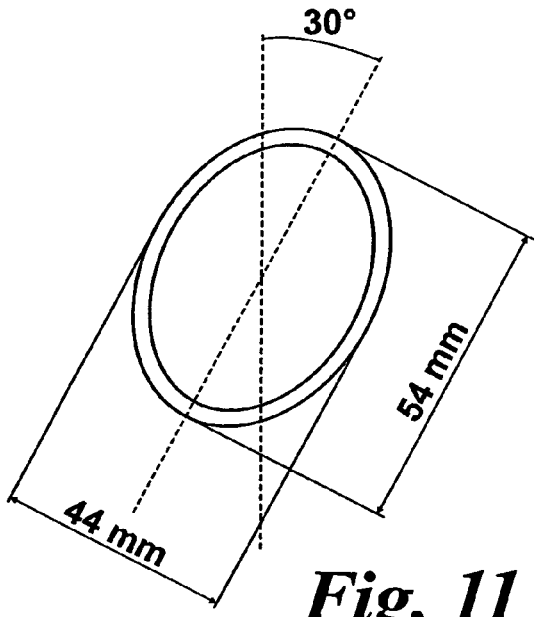
Fig. 11

OPERATOR CAGE

RELATED APPLICATIONS

This application is the U.S. National Phase filing under 35 U.S.C. §371 of PCT/GB2008/003127, filed Sep. 16, 2008, which designated the United States and was published in English, which claims priority under 35 U.S.C. §119(a)-(d) to Great Britain Patent Application No. 0718218.1, filed Sep. 19, 2007. The contents of these applications is incorporated herein by reference in their entireties.

FIELD OF THE INVENTION

The present invention relates to an operator cage for a machine, and in particular but not exclusively for a mobile elevating work platform (MEWP). The operator cage may also be used with other machines such as forklifts or telescopic handling machines ("telehandlers"), or provided as an attachment for use with such machines. The invention also relates to a mobile elevating work platform having an operator cage.

BACKGROUND OF THE INVENTION

A mobile elevating work platform conventionally consists of a base that is wheeled and may be either self-propelled or towable, an extending structure (for example a boom or other lifting structure) mounted on the base that may be articulated and/or telescopic, and an operator cage that is attached to the end of the extending structure. The operator cage provides the operator with an enclosed and protected area in which to stand while operating the MEWP. The cage also provides the operator with a platform from which to work when the cage is elevated.

Normally, the cage is a welded steel structure, consisting of base and a fence assembly of posts and rails that is welded to the base. There are a number of disadvantages associated with this type of cage. First, conventional steel cages tend to be heavy and influence the stability of the platform when raised. This affects the safe operating conditions of the platform. Further, operator cages are prone to receiving scrapes, knocks and other damage during use and transportation, and they suffer from corrosion. Cages therefore often have to be repaired or replaced altogether. However, conventional steel cages are difficult to repair and expensive to ship and replace.

Another problem with some MEWPs is that the gate through which an operator gains access to the operator cage is poorly designed. In many MEWPs, a gateway is provided in the fence assembly by omitting a section of a lower guard rail and replacing it with a sliding bar that is connected to the fence posts on either side and can be raised to gain access to the cage then dropped back into position to complete the loop of the lower guard rail. However, using this type of gateway is awkward and inconvenient, as the operator has to lift the sliding bar with one hand while ducking underneath that bar and climbing onto the platform. Consequently, it has been known for operators to fix the sliding bar in the raised position, contrary to safety requirements, thereby negating its effect and creating a safety hazard by increasing the risk that the operator might fall out of the cage.

Another safety hazard can occur if the MEWP is driven backwards with the platform raised, as the operator may not notice an overhead obstruction and may then collide with the obstruction and be crushed against the control console.

Similar risks may also arise in other machines, for example telehandlers and forklifts, in which an operator cage is fitted as an attachment to the load-bearing forks.

It is an object of the present invention to provide an operator cage that mitigates at least some of the aforesaid disadvantages.

SUMMARY OF THE INVENTION

According to one aspect of the present invention there is provided an operator cage for a machine, the cage comprising a base unit and a fence assembly releasably attached to the base unit, wherein the cage is constructed and arranged to be readily disassembled for convenient transportation. Advantageously, the fence assembly is constructed and arranged to be readily disassembled for convenient transportation. However, it may alternatively be constructed as a single unit, for example as a welded structure, that can be connected to the separate base unit.

The cage can be disassembled for convenient storage or shipping, then reassembled and mounted on the machine. Replacing a damaged cage is therefore simple and effective, and shipping costs are reduced. Replacing individual damaged components of the cage is also simple and convenient.

Advantageously, the base unit comprises a plastic or composite moulding. The use of plastic or composite components reduces the weight of the cage, thereby reducing the destabilising effect of the cage and allowing for economical shipping and convenient handling. Suitable composite materials may for example include fibrous reinforcing elements, for example of glass, para-aramid, carbon or polyamide, in a polymeric matrix. Preferred plastic or composite materials are corrosion-resistant, can be brightly coloured or luminescent without painting and can be more resilient than metal components.

The base unit preferably comprises a floor with a raised peripheral wall formed as an integral part thereof, which acts as a toe guard and prevents the operator slipping off the platform. Advantageously, the floor includes spaced upper and lower surfaces for increased strength and rigidity.

Advantageously, the fence assembly includes a plurality of posts that are releasably attached to the base unit and one or more rails that are supported by the posts. Preferably, the or each rail comprises a plastic or composite moulding, which may include moulded formations for receiving the support posts. The or each rail may include one or more moulded formations for use as a handle, a grip, a tool holder or a harness attachment point.

Advantageously, the fence assembly includes an upper rail having a first portion that is positioned at a first height above the base unit and a second portion that is positioned at a second height above the base unit, wherein the second height is greater than the first height and the second portion is located above a gateway providing access to the operator cage. The raised second portion of the upper rail allows easier access to the operator cage through the gateway and also provides some protection from collisions with overhead obstructions when maneuvering the machine.

Advantageously, the gateway includes a hinged gate below the second portion for controlling access to the cage. The gate may include a self-closing mechanism to ensure that it is normally closed during operation of the machine. Advantageously, the gate is pivotally mounted on a fence post and the self-closing mechanism includes a torsion spring recessed within a fence rail.

Advantageously, the operator cage includes a control console and the gate is constructed and arranged to obstruct access to the control console when the gate is open, thereby ensuring that the gate is properly closed during operation of the machine.

The operator cage may include a support frame attached to the underside of the base unit.

According to another aspect of the present invention there is provided an operator cage for a machine, the cage comprising a base unit and a fence assembly that includes a plurality of posts and at least one rail that is supported by the posts, said rail having a first portion that is positioned at a first height above the base unit and a second portion that is positioned at a second height above the base unit, the second height being greater than the first height and the second portion providing a guard to protect an operator while operating the work platform.

The raised second portion of the rail serves as a guard that helps to protect an operator from injury when operating the machine. For example, if a conventional MEWP is driven backwards, the operator may not see an obstacle and may be crushed against the control console. In the invention, the raised portion of the rail either protects the operator from colliding with the obstacle or ensures that there is sufficient clearance to prevent the operator being crushed. Advantageously, the second portion is located above a gateway providing access to the operator cage, and the fence assembly preferably includes a hinged gate.

Advantageously, the second height is in the range 110-190 cm, preferably 130-170 cm, more preferably 140-160 cm. Preferably, the difference between the second height and the first height is in the range 5-100 cm, preferably 10-70 cm, more preferably 20-50 cm.

Advantageously, the second portion is constructed and arranged such that it can be adjusted to an alternative position in which the second portion is positioned at a third height above the base unit, the third height being lower than the second height. The second portion may support one or more proximity sensors and/or crush sensors.

The fence assembly preferably includes a hinged gate. Preferably, the fence assembly includes a plurality of posts and one or more rails that are supported by the posts, the gate is pivotally mounted on a fence post and a self-closing mechanism that includes a torsion spring is recessed within a fence rail. Preferably, the operator cage includes a control console and the gate is constructed and arranged to obstruct access to the control console when the gate is open.

The provision of a pivoting gate greatly improves access to the cage and avoids the known problems of conventional lifting bar gates. This is particularly so when the gate is used in combination with a fence assembly that includes an upper rail with a raised portion located above the gateway. Correct use of the gate is ensured by constructing the gate so that it obstructs access to the controls when open.

According to another aspect of the invention there is provided an operator cage for a machine, the cage comprising a base unit, a fence assembly that includes a displaceable fence portion and a crush sensor that is constructed and arranged to sense displacement of the displaceable fence portion, wherein the displaceable fence portion is constructed and arranged to be displaced only when an external crush force applied to the displaceable fence portion exceeds a predetermined value.

The crush sensor senses external crush forces applied to the operator cage (either directly or through the operator). The crush sensor can help to protect the operator from danger in the event that the operator cage collides with an obstruction.

Advantageously, the crush sensor is constructed and arranged to sense external crush forces applied to an upper portion of the fence assembly.

If the operator cage includes a control console, the displaceable fence portion is preferably located adjacent the control console, more preferably adjacent the upper front edge of the console, to provide in use a physical barrier between an operator and the control console.

The operator cage may include control means for controlling or restricting operation of the machine when the crush sensor senses an external crush force applied to the operator cage.

According to another aspect of the present invention there is provided a machine comprising a wheeled base, an extending structure and an operator cage attached to the extending structure, wherein the operator cage is as defined by any one of the preceding statements of invention, or any combination thereof.

Various embodiments of the invention will now be described, by way of example, with reference to the accompanying drawings, in which:

BRIEF DESCRIPTION OF THE DRAWINGS

FIG. 11 is a cross-sectional view of a hand grip;

FIG. 16 is a perspective view of a fourth operator cage, and

FIG. 17 is a perspective view at an enlarged scale showing part of the fourth operator cage.

DETAILED DESCRIPTION OF THE PREFERRED EMBODIMENT

Figure 1:
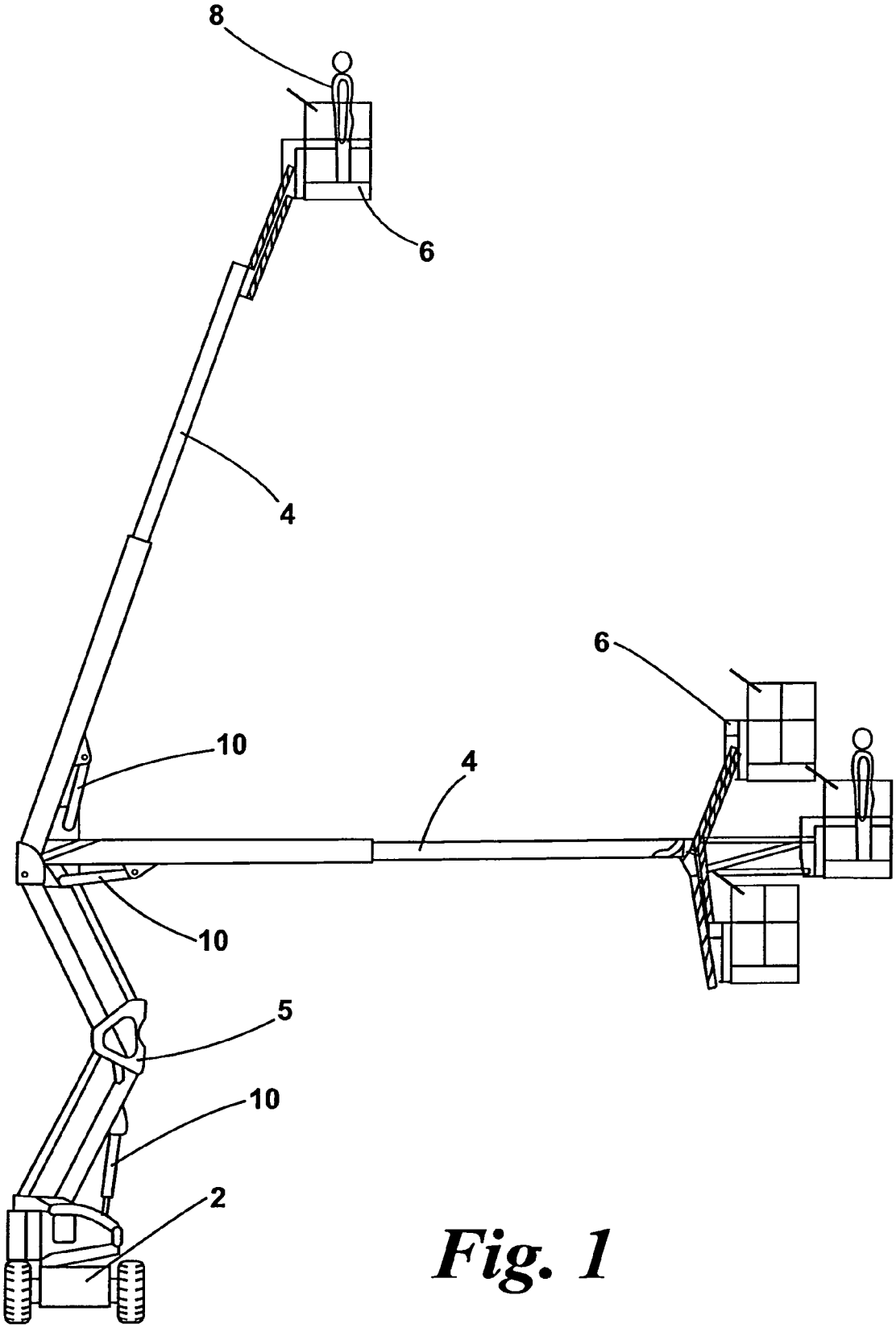
FIG. 1 is an end view of a typical mobile elevating work platform.
Figure 2:
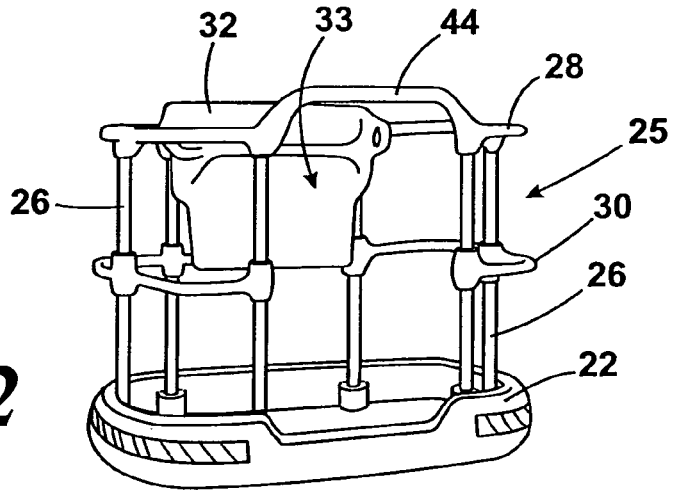
FIG. 2 is a perspective view of a first operator cage.
Figure 3:
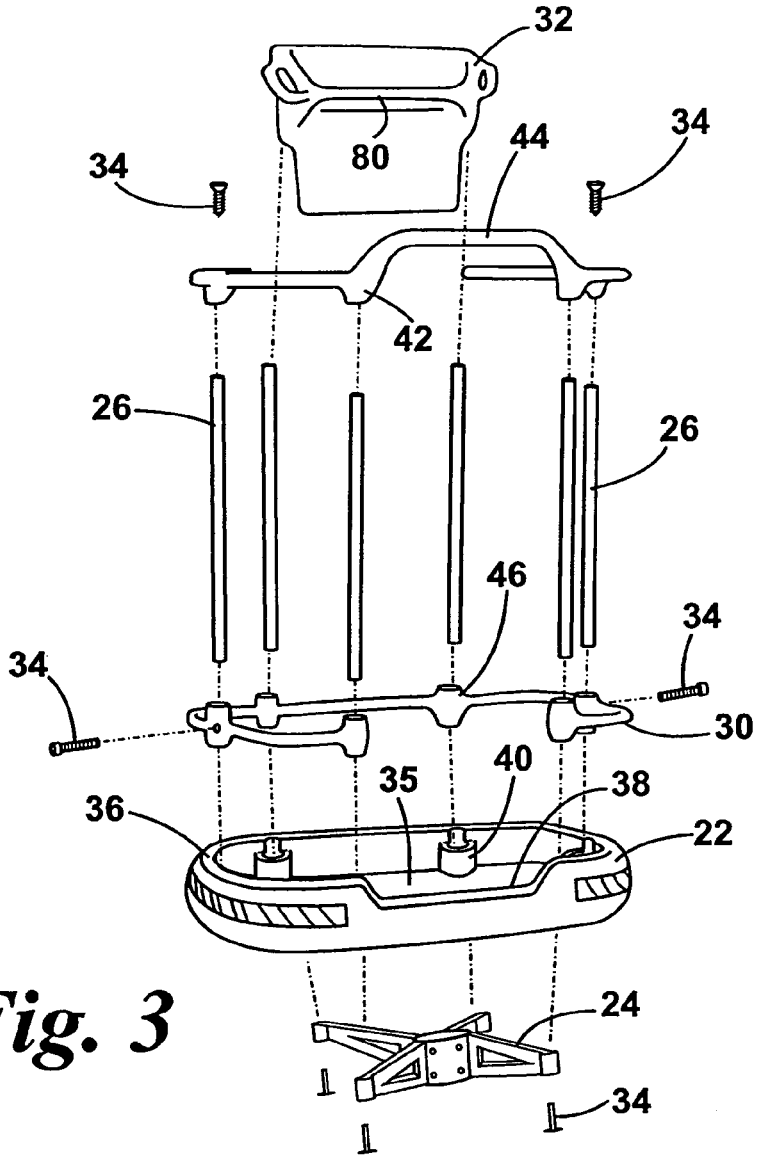
FIG. 3 is an exploded perspective view showing the components of the first operator cage.

FIG. 1 shows a typical mobile elevating work platform, which includes a wheeled base 2, a hydraulically operated extending structure comprising a boom 4 and a lifting structure 5, and a cage 6 for a human operator 8. The boom 4, which is shown here in two different operating configurations, may be retracted and folded onto the wheeled base 2 for transportation or storage. Movement of the boom is controlled by various hydraulic cylinders 10, which are connected to a hydraulic drive system (not shown). Hydraulic motors may also be provided for driving the wheels of the wheeled base 2.

Apart from the operator cage 6, the components shown in FIG. 1 are all conventional and will not therefore be described in detail. It should be understood that the mobile elevating work platform may take various alternative forms.

The first operator cage 6 shown in FIGS. 2 to 5 includes a substantially rectangular base unit 22, a support bracket 24, a fence assembly 25 comprising six upright support posts 26, an upper guard rail 28 and a lower guard rail 30, and a control console 32. In this example, two of the support posts 26 are located at the ends of the cage and the remaining six support posts are located adjacent the sides of the cage. The number of posts and their position may of course be varied. A portion of the lower guard rail 30 is omitted to provide a gateway 33, allowing access to the operator cage.

Figure 4:
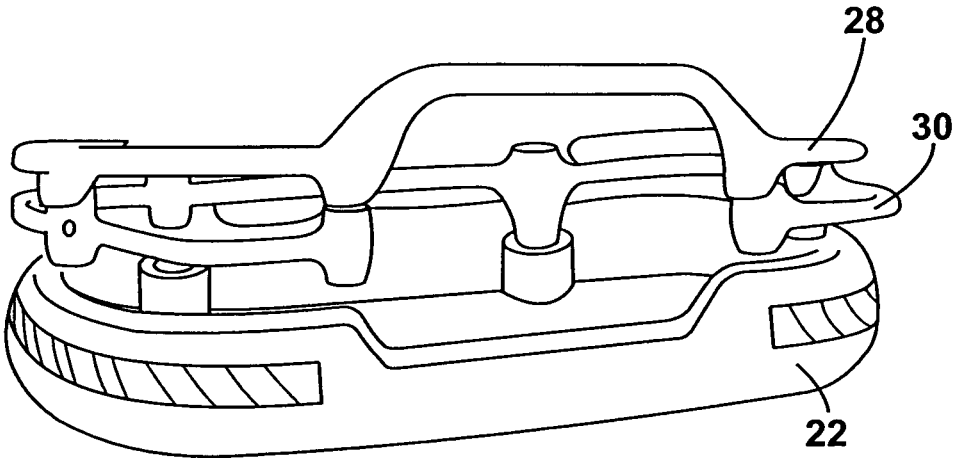
FIG. 4 is a perspective view showing the components of the first operator cage in a collapsed shipping condition.

The base unit 22, the upper guard rail 28, the lower guard rail 30 and the control console 32 are all moulded plastic or composite components. The support frame 24 is preferably made of metal, for example welded steel or cast aluminium. The support posts 26 are preferably cylindrical aluminium tubes having internal screw threads at both ends. Preferably, the internal screw threads are provided by inserting star nuts into the ends of the tubes having an interference fit therewith. Alternatively, the tubes may be made of a plastic or composite material, for example by a pultrusion moulding process. The operator cage is assembled from the above-mentioned components, which are fixed together using screws or bolts 34. This allows individual components to be easily removed and replaced if repair is required. It also allows the operator cage to be collapsed for shipping as shown in FIG. 4. After delivery, the cage can be assembled on site and mounted on the boom of the MEWP.

The base unit 22 is formed as a single moulding from a fire-retardant and UV-stable plastic or composite material. It is preferably hollow, comprising an outer skin enclosing a sealed cavity. A number of moulded formations interlinking the opposite surfaces may be provided to increase the strength and rigidity of the unit. The enclosed cavity may optionally be filled with a rigid foam material for even greater strength and rigidity.

The floor of the base unit 22 includes upper and lower surfaces that are separated by a distance of approximately 25 mm. This double floor arrangement provides increased safety as compared to conventional single floor cages. The upper floor surface 35 is surrounded by a raised toe guard or bumper 36, which has a reduced height entry portion 38. A number of moulded formations 40 for receiving the lower ends of the support posts 26 are formed around the inner periphery of the toe guard 36. The toe guard 36 prevents the operator's feet from slipping off the platform and protects them from collision with any obstacles. It also serves to increase the strength and rigidity of the base unit 22.

A number of slots (not shown) may be formed in the floor of the base unit 22 for drainage and visibility. These slots are formed during moulding and interconnect the upper and lower floor surfaces for increased strength and rigidity.

The support frame 24 is attached to the underside of the base unit with bolts 34 that pass through the support frame 24 and the base unit 22 and are screwed into the threaded ends of the side posts 26. The support frame 24 includes a conventional fixing allowing it to be attached to the end of the operating boom 4 of the MEWP.

The moulded plastic or composite base unit 22 is lighter than a conventional metal component and has improved rigidity. It also has improved robustness as the resilience of the plastic or composite material gives it the ability to recover its shape after an impact. The plastic or composite material is corrosion resistant and it may be moulded in any colour or in a luminescent material for high visibility, and does not require painting. The moulded base unit is simple to manufacture and it also provides improved soundproofing as compared to a conventional metal base unit.

The upper guard rail 28 comprises a single part moulding, which is made from a fire-retardant and UV-stable plastic or composite material. The upper guard rail 28 is in the shape of a hoop having moulded formations 42 on its underside for receiving the upper ends of the support posts 26. These are secured in position with bolts 34 that are screwed through the guard rail into the threaded upper ends of the support posts 26. The front section of the guard rail is omitted to allow it to accommodate the control console 32. The upper guard rail 28 includes an entry portion 44 that is raised to allow easy access to the cage through the gateway 33. The raised portion 44 of the upper guard rail also provides protection from overhead obstructions while reversing. Preferably, the height of the raised portion 44 is at least 30 cm greater than the height of the control console 32, to ensure that there is sufficient clearance to prevent an operator being crushed against an unseen overhead obstruction. Optionally, one or more crush sensors and/or proximity sensors may be mounted on the raised portion 44.

The control console 32 preferably includes a hand rail 80 that extends across the front of the console. This hand rail 80 provides the operator 8 with a support that he or she can hold to avoid overbalancing when maneuvering the cage 6. This helps to prevent inadvertent operation of the controls if the operator reaches for support when overbalancing.

The lower guard rail 30 is also a single part moulding, which is preferably made from a fire-retardant and UV-stable plastic or composite material. It is in the shape of a hoop and has moulded formations 46 for receiving the support posts 26. It is secured by bolts 34 that are screwed through the rail into the support posts. The rear portion of the lower guard rail 30 is omitted to provide a gateway 33 allowing access to the operator cage. Optionally, a conventional sliding guard bar (not shown) may be mounted on the fence posts 26 on either side of the gateway 33. In use, the sliding bar may be raised to allow access to the operator cage then dropped back into position level with the lower guard rail to complete the loop of the lower guard rail.

Figure 5:
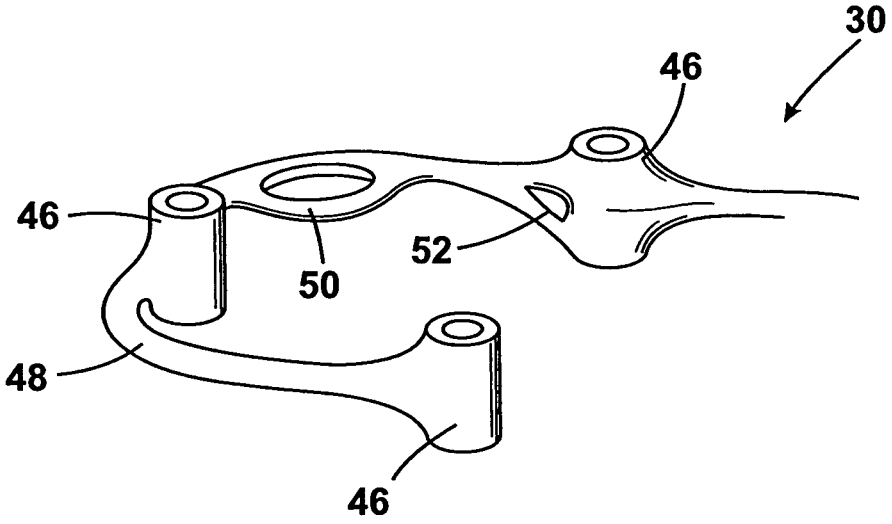
FIG. 5 is a perspective view at an enlarged scale showing a part of the first cage.

As shown in FIG. 5, the lower guard rail 30 may optionally include a number of moulded features such as ergonomic hand grips 48 or handles, tool holders 50 or anchor lugs 52 for a safety harness. Similar formations may also be provided on the upper guard rail 28.

A preferred form of an ergonomic hand grip 48 is shown in FIG. 11. This hand grip 48 is oval in shape with a major axis dimension of about 54 mm and a minor axis dimension of about 44 mm, the major axis being tilted at an angle of about 30° from the vertical.

The lower guard rail 30 is shaped so that it extends outwards beyond the upper guard rail 28 by a distance of approximately 30 mm. It therefore acts as a bumper that helps to prevent the upper guard rail 28 from colliding with upright obstacles and serves as a finger guard to protect the hands of an operator holding the upper guard rail 28.

The console 32 carries the controls (not shown) for the MEWP drive system. The console is made as a single part moulding from a fire-retardant and UV-stable plastic or composite material. It is attached to the support posts and the upper and lower guard rails in the front portion of the operator cage by bolts 34 that are screwed into the ends of the support posts 26.

Figure 6:
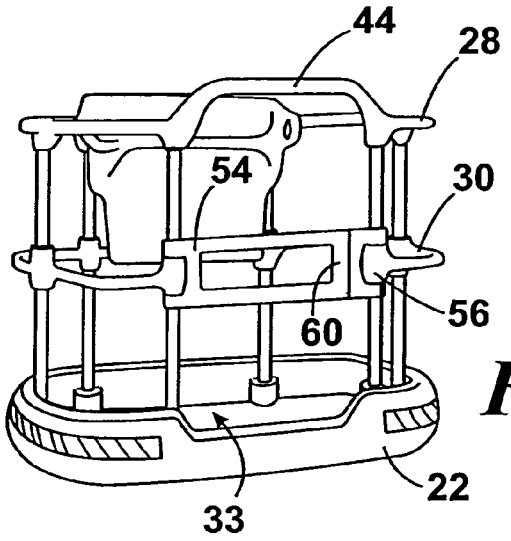
FIG. 6 is a perspective view showing a second operator cage in a first configuration.
Figure 7:
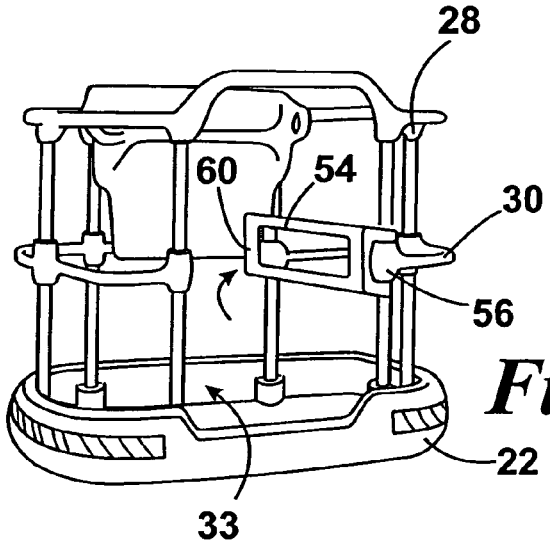
FIG. 7 is a perspective view showing the second operator cage in a second configuration.
Figure 8:
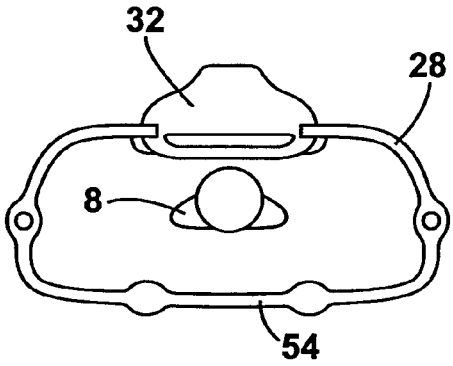
FIG. 8 is a plan view of the second operator cage in the first configuration.
Figure 9:
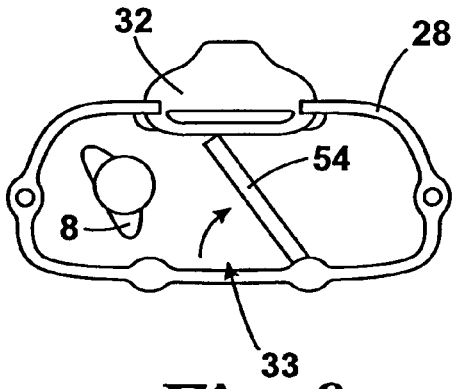
FIG. 9 is a plan view of the second operator cage in the second configuration.

The second operator cage shown in FIGS. 6 to 10 is similar to the first operator cage, except that it includes a pivoting gate 54 in the gateway 33 in the rear part of the cage. The gate 54 is attached to the lower guard rail 30 and pivots inwards as shown in FIGS. 7 and 9 to allow an operator 8 to enter or leave the cage. A spring return mechanism 56 is incorporated into the lower guard rail 30 to ensure that the gate 54 returns automatically to the closed position as shown in FIGS. 6 and 8. A latching mechanism (not shown) for retaining the gate 54 in the closed position may optionally be provided. When the gate 54 is open as shown in FIGS. 7 and 9, it restricts access to the control console, thereby ensuring that the operator 8 closes the gate before attempting to operate the MEWP.

Figure 10:
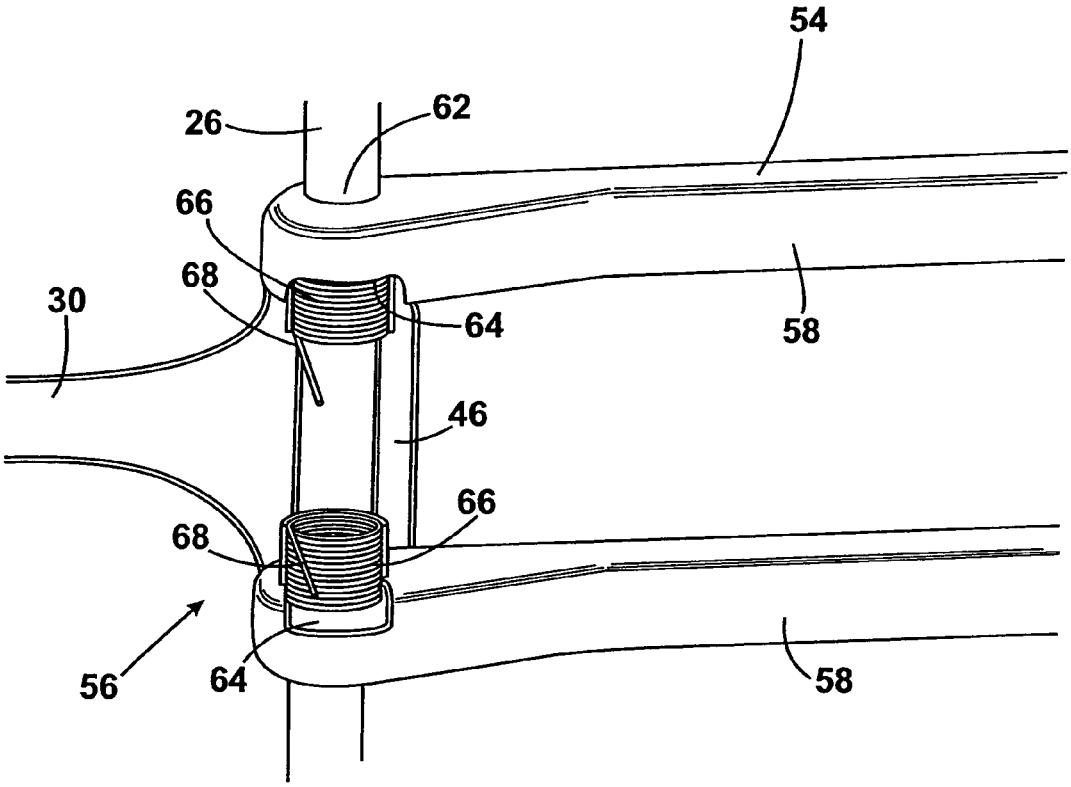
FIG. 10 is a perspective view showing at an enlarged scale the components of a spring return mechanism of the second operator cage.

As shown in detail in FIG. 10, the gate 54 comprises a substantially U-shaped plastic or composite moulding having two parallel horizontal bars 58 that are interconnected at the free end of the gate by a vertical crosspiece 60. The horizontal bars 58 include at their inner ends two axially-aligned vertical bores 62 and a pair of inwards-facing recesses 64 that accommodate a pair of torsion springs 66.

When assembled, the gate 54 is supported by one of the fence assembly support posts 26, which passes through the bores 62 at the inner ends of the horizontal bars 58, and by the moulded formation 46 at the end of the lower guard rail 30. The torsion springs 66 are accommodated within recesses 68 in the ends of the moulded formation 46. In use, the springs 66 are pre-stressed so that they urge the gate 54 towards the closed position.

The gate 54 may take various different forms, according to the requirements of the operator. For example, a taller gate may be provided. This may allow the height of the cage gateway 33 to be increased, since current safety regulations (EN280 standard) require that the maximum gap between entry portion 44 of the upper guard rail 28 and the top of the gate 54 is 550 mm. Providing a taller gate thus allows the height of the gateway to be increased by, for example, 100 mm, 200 mm or 500 mm.

As with the first cage shown in FIG. 4, the cage 6 may be disassembled and collapsed for shipping in "flat-pack" configuration, with the upper and lower guard rails 28,30 placed on top of the base unit 22. The other components (not shown) including the support posts, the console, the gate and the fastening bolts may be placed on top of the base unit 22. Upon delivery, the cage can be easily assembled and attached to the MEWP. If any parts of the cage are damaged, they can be easily removed and replaced with new parts.

Figure 12:
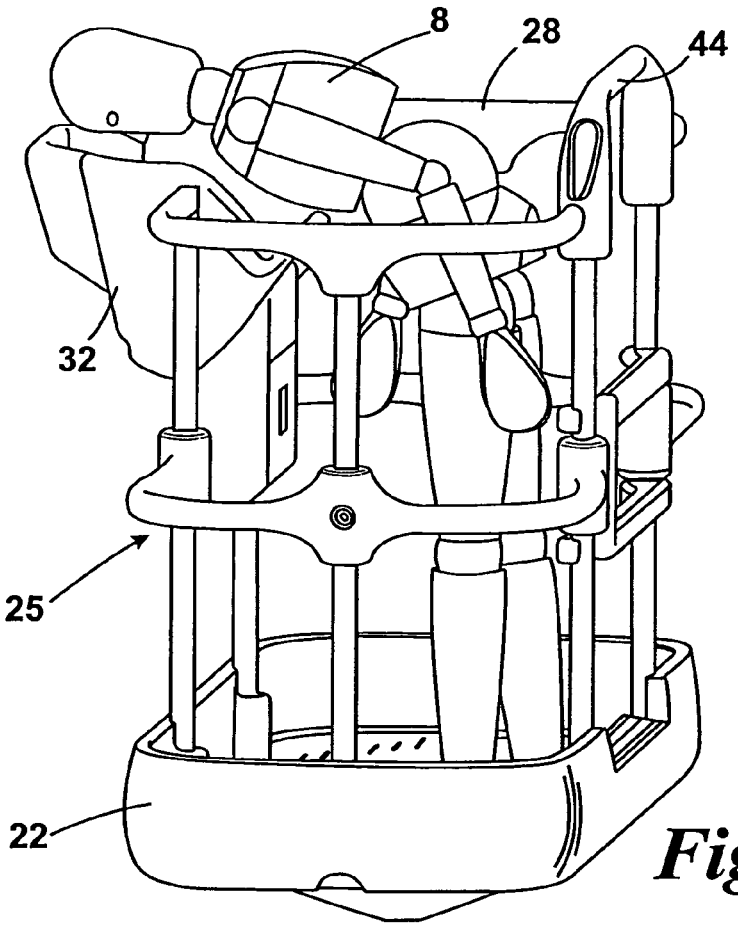
FIG. 12 is a perspective view of a third operator cage.
Figure 13:
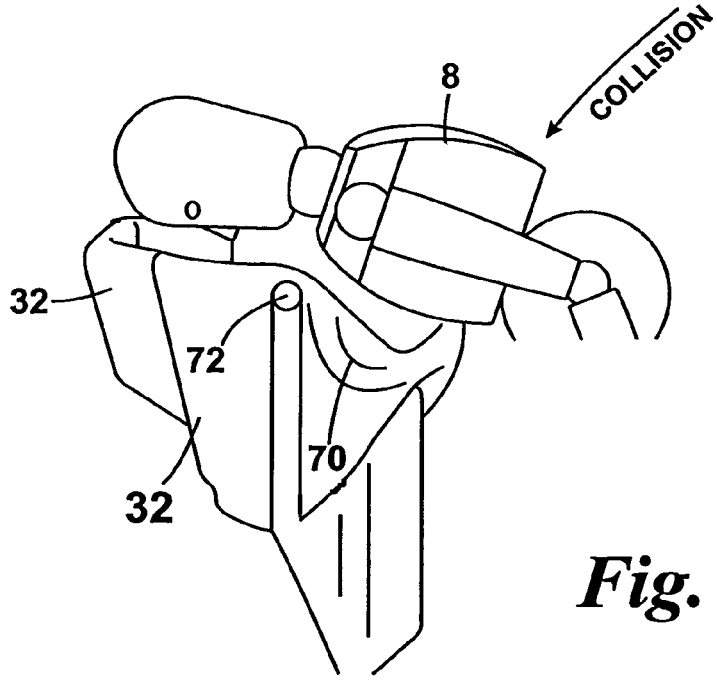
FIG. 13 is a perspective view at an enlarged scale showing part of the third operator cage.
Figure 14:
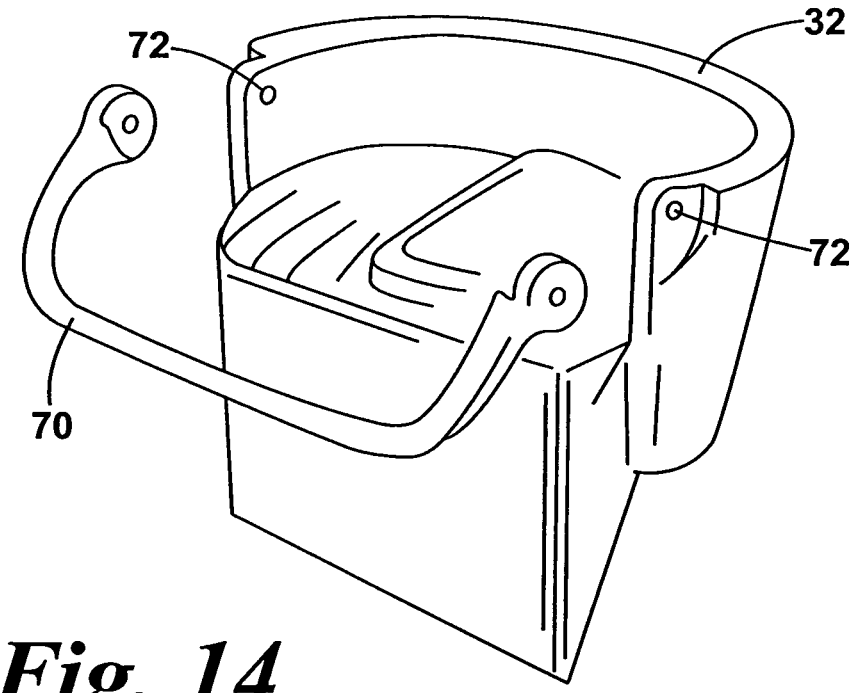
FIG. 14 is a perspective view at an enlarged scale showing part of a control console and a hand rail of the third operator cage.

FIGS. 12 to 15 illustrate another embodiment of the invention in which the operator cage 6 includes a crush sensor for sensing external crush forces applied to the operator cage, as may be caused for example by a collision between an obstruction (not shown) and either the cage 6 or the operator 8. Such a situation might arise for example when the operator cage 6 is being raised or driven backwards, if the operator 8 does not see the obstruction. As a result, the operator 8 might be trapped between the obstruction and the control console 32 as illustrated in FIGS. 12 and 13. This might cause a serious risk of injury, particularly if the operator 8 is trapped in a position that actuates the controls, causing the operator cage 6 to be driven further towards the obstruction.

In this embodiment, the crush sensor comprises a hand rail 70 that extends across the front of the control console 32. The hand rail 70 is U-shaped and is connected by a pivot joint 72 at each end of the handle 70 to the sides of the control console 32. The control console 32 is supported in turn by the upper guard rail 28 of the fence assembly 25, which is mounted on the moulded plastic or composite base unit 22.

Figure 15:
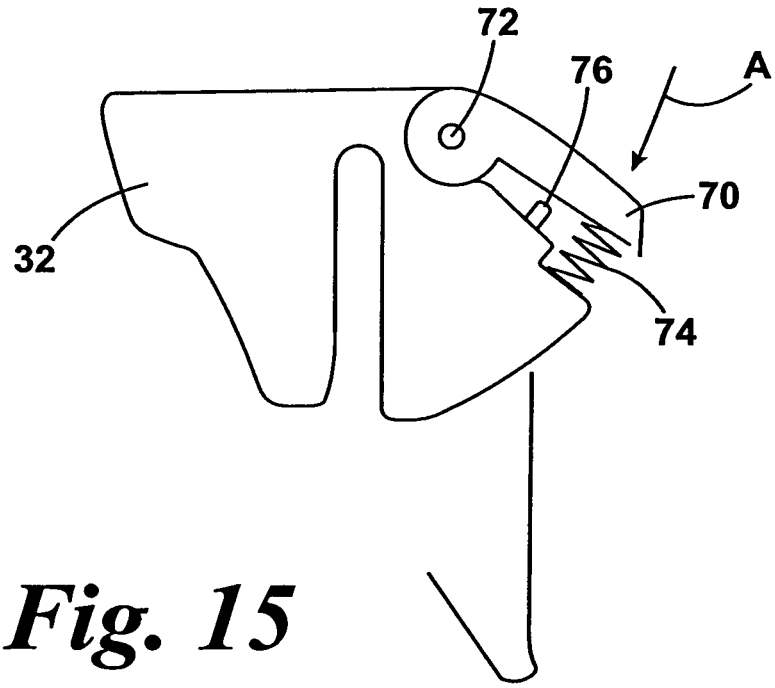
FIG. 15 is a cross-sectional view showing part of the control console and the hand rail of the third operator cage.

As shown in FIG. 15, the hand rail 70 is biased upwards by a strong compression spring 74. However, if a sufficient downwards force is applied to the hand rail 70 in the direction of arrow A, the bias force of the spring 74 can be overcome allowing the hand rail to activate a sensor switch 76 located beneath the rail. This switch 76 is connected to a control device (not shown) that controls or restricts operation of the machine when activated. The downward movement of the hand rail 70 also helps to relieve the crushing force felt by the operator 8.

Therefore, if the operator 8 is crushed against the control console 32 as shown in FIGS. 12 and 13, the crush sensor senses the external crushing force and activates the control device, which then prevents further movement of the cage 6. The control device may include an override control, which allows limited movement of the cage after activation, for example allowing the cage to be moved away from the obstruction. Generally, any such movement will be restricted to a very low speed. The control device may also actuate an alarm. It may also include a reset control, allowing normal operation to be resumed after the crushing force has been removed.

An alternative form of crush sensor is illustrated in FIGS. 16 and 17. In this arrangement, the control console 32 includes an integral hand rail 80 that extends across the front of the console and is supported on either side by a moulded plastic or composite support structure 82. V-shaped slots 78 are formed in the front edges of the support structure on either side of the console 32 in order to weaken the structure. If an excessive downwards force is applied to the hand rail 80, the support structure 82 buckles in the weakened regions around these slots 78, allowing the hand rail 80 to be displaced downwards. This relives some of the force felt by the operator and at the same time displacement of the hand rail is sensed, thereby activating the control device (not shown). The control device then activates an alarm and controls or restricts operation of the machine as described previously. Displacement of the hand rail 80 may be sensed by means of a switch, a fuse or any other suitable device. Alternatively, pressure sensors or strain gauges may be provided to sense an excessive crush force applied to the console or a hand rail or support in the vicinity of the console.

A crush sensor may be provided elsewhere on the cage, for example on the raised portion 44 at the rear of the upper guard rail 28. Alternatively or additionally, one or more ultrasonic proximity sensors may be mounted on the cage to provide a warning and/or to control or restrict movement of the cage if it comes into close proximity with an obstacle.

Various modifications of the invention are of course possible. For example, the gateway may be positioned at one end rather than at the rear of the cage, and the raised portion of the upper rail may be positioned away from the gateway. The extending structure may take various other forms, including scissor structures and extending links. The support frame may be moulded into the base. The upper rail may include a reinforcing material such as a steel cord or a fibrous reinforcing material (e.g. KEVLAR™) to reduce the risk of the rail being damaged during use, for example from contact with a cutting tool. The second portion of the upper rail may be hinged, removable or otherwise adjustable such that it can alternatively be located in a lower position, for example level with the first portion of the upper rail. In certain circumstances it may be desirable to place the second portion of the rail in this lower position to avoid obstructing any operations being carried out by the operator. Furthermore, certain aspects of the invention, for example the raised portion of the upper rail and/or the pivoting gate and/or the crush sensor, may be embodied in an operator cage that is not designed to be disassembled and/or that does not include components made of a plastic or composite material.

The operator cage or features thereof may also be used or designed for use with various types of machine other than mobile elevating work platforms. For example, the operator cage may be designed for use with machines such as telescopic handling machines ("telehandlers") or other machines where an operator cage is provided to accommodate (and generally protect) the operator.

The invention claimed is:

1. An operator cage for a machine, the cage comprising a base unit, a control console, a fence assembly that includes a displaceable fence portion comprising a hand rail or support that extends across the front of the control console, wherein the displaceable fence portion is located adjacent the control console to provide a physical barrier between an operator and the control console, a crush sensor that senses an external crush force applied to the displaceable fence portion only when the external crush force exceeds a predetermined value, and a control device that controls or restricts operation of the machine when the crush sensor senses an external crush force, wherein the displaceable fence portion is connected to the control console by a plastic or composite support structure having weakened regions, said weakened regions comprising slots in the support structure, whereby if a sufficient downwards force is applied to the displaceable fence portion by an operator when subjected to an external crush force said displaceable fence portion is displaced downwards to relieve the crush force felt by the operator.

2. The operator cage according to claim 1, wherein the control device comprises an override control that allows limited movement of the cage after the crush sensor senses an external crush force.

3. The operator cage according to claim 1, wherein the control device comprises an alarm that is activated when the crush sensor senses an external crush force.

4. The operator cage according to claim 1, wherein the control device comprises a reset control that allows normal operation to be resumed after the external crush force has been removed.

5. A machine comprising a wheeled base, an extending structure and an operator cage according to claim 1 attached to the extending structure.

6. The operator cage according to claim 1, wherein if an excessive downwards force is applied to the displaceable fence portion the support structure buckles in the weakened regions.

7. The operator cage according to claim 1, wherein the limited movement of the cage is in a direction away from an obstruction.

8. The operator cage according to claim 1, wherein the crush sensor comprises a sensor switch.

* * * * *